US007900488B2

(12) United States Patent
Hedegaard

(10) Patent No.: US 7,900,488 B2
(45) Date of Patent: Mar. 8, 2011

(54) METHOD AND MACHINE FOR NON-DESTRUCTIVE STRETCHING AND FASTENING OF A PELT ON A PELT BOARD

(75) Inventor: Jens Hedegaard, Holstebro (DK)

(73) Assignee: Dansk Mink Papir A/S, Holstebro (DK)

( * ) Notice: Subject to any disclaimer, the term of this patent is extended or adjusted under 35 U.S.C. 154(b) by 1270 days.

(21) Appl. No.: 10/595,184

(22) PCT Filed: Sep. 20, 2004

(86) PCT No.: PCT/DK2004/000636

§ 371 (c)(1),
(2), (4) Date: Mar. 20, 2006

(87) PCT Pub. No.: WO2005/028682

PCT Pub. Date: Mar. 31, 2005

(65) Prior Publication Data

US 2007/0028655 A1 Feb. 8, 2007

(30) Foreign Application Priority Data

Sep. 19, 2003 (DK) ..... 2003 01373

(51) Int. Cl.
*C14B 1/26* (2006.01)

(52) U.S. Cl. ..... 69/19.1; 69/19

(58) Field of Classification Search ..... 69/19.1–19.3, 69/1, 22, 23

See application file for complete search history.

(56) References Cited

U.S. PATENT DOCUMENTS 1,271,418 A * 7/1918 Barnes ..... 69/19.2

(Continued)

FOREIGN PATENT DOCUMENTS

WO WO02/44428 * 6/2002

*Primary Examiner*—Shaun R Hurley
*Assistant Examiner*—Andrew W Sutton
(74) *Attorney, Agent, or Firm*—Roberts Mlotkowski Safran & Cole, P.C.; David S. Safran

(57) ABSTRACT

In connection with the non-destructive stretching and fastening of pelts (2) on distention elements/pelt boards (4), where the pelt is stretched and fastened in the stretched position during the drying process by means of a fixing bag, it has shown that the pelts give way (shrink) on each side of the tail root of the pelt, with the result that use is made of a number of staples for the fastening of these places on the stretched pelt. Since it is not at all desirable to use staples, a development of the pelt boards (4) has taken place, so that these have an arched extent around two transverse axes in relation to their longitudinal axes. Moreover, it has long been desirable to be able to stretch the pelts to a greater degree, which has not been possible with the use of the known stretching machines. This development has led to the development of a method and a stretching machine for the execution of the method, where the gripping elements are configured to correspond with the shape of the pelt board, and where the pelt is engaged by the gripping elements along the whole of the lower periphery of the pelt, so that the counter-hold force in the pelt is distributed over the whole periphery of the pelt, whereby the pelt can be stretched to a greater degree without any damage to the pelt in the areas of engagement for the gripping elements.

8 Claims, 12 Drawing Sheets

U.S. PATENT DOCUMENTS 1,731,144 A * 10/1929 Lord ..... 69/19.2
2,147,039 A * 2/1939 Johanson ..... 69/19.3
5,396,721 A * 3/1995 Levine et al. ..... 38/102.3
6,915,669 B2 * 7/2005 Hedegaard ..... 69/19.3

* cited by examiner

METHOD AND MACHINE FOR NON-DESTRUCTIVE STRETCHING AND FASTENING OF A PELT ON A PELT BOARD

BACKGROUND OF THE INVENTION

1. Field of the Invention

The present invention relates to a method for the non-destructive stretching and fastening of pelts on a pelt board, for which is used a machine of the kind which comprises holding means for engagement of the lower end of a respective pelt board and gripping elements for securing the lower end of a pelt applied loosely on said pelt board during the stretching of the pelt on said board, where the pelt board is placed in the holding means, and where the gripping elements comprising inner parts and outer parts are brought into engagement with the pelt by the introduction of the inner parts between the surface of the pelt board and the leather side of the pelt, and the outer parts opposite the inner parts are displaced towards the fur side of the pelt for securing the pelt between the inner parts and the outer parts, and where the stretching takes place by effecting a displacement between the gripping elements and the holding means for the lower end of a relevant pelt board, and where an effective fastening of the pelt in the stretched position on the pelt board is established by the drawing of a holster-like bag (fixing bag) over the fur side of the pelt, which at least over a part of the lower end of the pelt (the tail end) is brought into tight contact with the fur side of the pelt, followed by a releasing of the gripping elements from the pelt and a releasing of the holding means from the distension element, and a stretching machine for the execution of the method.

2. Description of Related Art

In the drying of pelts, for example, a mink or a fox pelt (in the following referred to jointly as a pelt), after skinning and scraping off the layer of fat on the leather side of the pelt, the pelts are stretched, for example, on a pelt board which is often first provided with a fat-absorbing material, the object being that, during the drying of the pelt, the fat remaining on the leather side of the pelt will be drawn into the paper and hereby removed from the pelt.

In the following, some definitions are provided which will be used in the specification and claims.

The mounting of pelts is to be understood as a procedure which comprises the drawing of a pelt over a pelt board, preferably with the leather side of the pelt facing towards the surface of the board, the stretching of the pelt on the pelt board and the fastening/securing of the pelt in the stretched position on the pelt board.

The use of pelt boards in connection with the drying of pelts is well-known, and with the passing of time, a great number of configurations of such pelt boards has been developed with the view of improving the drying of pelts. With the mechanization and organizing of production and sale of pelts which has taken place, there has also occurred a certain standardization of pelt sizes, and herewith, also of the pelt boards on which the pelts are stretched and fixed in this position during the drying, the object being to be able to achieve the best possible and uniform pelt quality, which means that the producers can obtain a higher price for the pelts.

Those pelt boards which have become most widespread, and which today are used by the majority of the producers of pelts, including in particular mink pelts, are made of wood, and can briefly be described as a flat piece of wood with a first broadside surface and a second broadside surface, and a first narrow side surface and a second narrow side surface, the breadth of which is essentially considerably less than the breadth of the broad side surface, and where the one end of the board (the foot end) is cut off at right-angles to the longitudinal axis of the board, and the lower end nearest the foot end has constant breadth, but hereafter this breadth gradually decreases towards a pointed but rounded end part (the front end, the nose end), and where the pelt board has a through-going slot between the first broadside surface and the second broadside surface, said slot lying symmetrically around the longitudinal axis of the board and extending between near the pointed end part and at least for over a half of the length of the board.

The pelt board described above is a pelt board intended for the pelts from male animals, which are normally larger than the pelts from female animals. A pelt board intended for use in the drying of the leather side of pelts from female animals does not comprise a lower end where the breath of the board is constant.

The "nose end" of the pelt shall be understood to be that part of the pelt which previously covered the cranium of the furred animal, and in connection with the mounting of the pelt is that part of the pelt which is placed in/over the pointed but rounded end of the board, which can randomly be referred to as the front end or the nose end of a pelt board.

The "tail end" of the pelt shall be understood as that end of the pelt where the tail sits firmly and from where the tail extends from the lower edge of the back, and which collectively can denote the whole circumference of the pelt in said area. In the mounting of the pelt, the tail end of the pelt is always placed nearest the foot end of the board.

The lower end of the back of the pelt shall be understood to be that part on both sides of the area where the tail extends from the lower edge of the back of the pelt.

The belly side of the pelt shall be understood to be that side of the pelt where the forelegs and thighs are placed.

In the following, a "mounted" pelt shall be understood to be a pelt drawn onto a pelt board where it is stretched and fixed in this position on the board.

In the following, the removal of the pelt from the pelt board, typically after the conclusion of the drying process, is to be understood as the removal of a pelt which has been stretched and fixed in this position on the board during the drying process. The procedure for removal also includes the removal of any elements which may have been used for the fixing of the pelt in the stretched position on the pelt board.

In certain cases, the fat-absorbing material which is placed on the board before the drawing-on of the pelt is a bag made of fat-absorbing material, preferably of fat-absorbing paper with perforations, for example, in the form of a so-called "pelt bag," which will thus be lying between the pelt board and the leather side of the pelt.

The drying procedure or drying of pelts shall be understood to be a drying-out of the leather side of the pelt to a preferred extent which from experience excludes oxidation and the attack on the pelt by mites. The drying process is typically effected by the blowing of dry air in the slot in the board via pipes which are introduced into the slot and via the perforations in the walls of the pelt bag, so that the dry air is diffused out to the leather side of the pelt and dries the pelt.

In the drawing of the pelt on to the pelt board, a stretching of the pelt is often effected mechanically in order to achieve the greatest possible length of the pelts, and herewith the highest obtainable price at the fur auction.

The hitherto most used method of mounting a pelt is that of manually drawing the pelt over the pelt board with the leather side facing the board, which is then inserted into a machine comprising holding means for fastening of the board's lower end, which extends below that part of the board which is covered by the pelt, i.e., after the pelt has been stretched on the board by the machine. Hereafter, the gripping elements are inserted into engagement between the leather side and the fur side of the pelt on the back and the belly side respectively, after which the pelt is stretched out on the board by a relative displacement between the gripping elements and the board, after which the pelt is fastened in the stretched position on the board by the insertion of staples/clips which penetrate the pelt and are anchored in the board itself.

Then, the pelt is dried while stretched on the board, which gives rise to elongated holes in the pelt from the clips/staples which secure the pelt to the board. The result is that the holes, which appear both in the back of the pelt, which is the most valuable part of the pelt, as well as the belly part, make the pelt in these areas worthless, in that this part of the pelt with the holes can not be used in the further processing of the pelt. Thus, the placing of the clips/staples so close to the under edges of the pelt, without the pelt drawing itself free of the clips during the drying with further damage to the pelt, is important. Stretching machines have been developed for this purpose, which are known from Danish Patent DK 169525, which discloses a stretching machine comprising gripping elements and sensors which control the extent of the stretching of the pelt on the board, so that the optimal stapling can take place without tearing out of the staples.

In the removal of the pelt from the board, the stapling of the pelts gives rise to the need for manual labour to a not inconsiderable degree in connection with the removal of the staples, in that the removal of the staples must take place without any further damage to the pelt. Finally, the use of staples/clips for the fixing of the pelt results in damage to the material of which the board is made, which is most often wood so that, after a time, the board must be replaced.

The ideal method for stretching and drying of the pelt will thus involve being able to fix the pelt in the stretched position without the use of staples. From International Patent Application Publication WO-A1-0162985, there is known a method and a fixing bag for fixing of the pelt in the stretched position during the drying whereby, after the pelt has been stretched on the board, a bag is drawn over the fur side of the pelt, the inside dimensions of said bag being such that the outwardly-directed forces of the fur side of the pelt press the leather side of the pelt so much against the board that the pelt is thereby secured in the stretched position, without the use of staples which penetrate both the pelt and the board. The above-mentioned reduction in the value of the pelt as a result of holes is thereby avoided, which means that it will be possible to achieve an appreciably higher price for the pelt.

Danish Patent Application DK 2000 01174L describes a method and machine for the stretching of pelts, where the machine is arranged with gripping elements in a manner which enables a fixing bag to be drawn over a pelt which is stretched on a traditional board by the machine, where the holding elements comprise flat beak-shaped holding elements which respectively grip the back part and the belly part (the leg side) of the pelt from below, which means that the fixing bag can be drawn over the pelt to a level below the lower edge of the back part.

However, practical use of this method has shown that the pelt shrinks on each side of the tail root during the drying, which often results in a reduced price for the pelts as a consequence of the pelt not having the expected size after the processing. The reason for this is partly that the fixing bag can not exert enough pressure against the fur side of the broad sides of the pelt for sufficient friction to arise between the surface of the board and the leather side of the pelt to counteract the slipping of the above-mentioned sides of the pelt. The result is that use is still made of a smaller number of staples for the fixing of said slipping parts of the pelts during the drying process, the reason being that the price reduction per pelt at a lower size category is greater than the price reduction for the few holes left in the pelt by the staples.

A solution to this problem could be to stretch the pelts somewhat longer on the boards, but the known pelt machines do not offer adequate facilities for a preferred stretching of the pelt on the boards where, with the holding elements of the known pelt machines, a counter-hold is established during the stretching of the pelts along two relatively narrow engagement surfaces on one or both of the flat sides of the pelt, with the result that, if the pelts are stretched to a greater degree, they will be damaged in the holding areas, which are also the most valuable parts.

In the meantime, a further development has taken place of the pelt boards which are used in connection with the stretching, fixing and drying of pelts, so that it is possible to achieve an effective fixing of the pelt during the drying process without shrinking/slipping of parts of the pelt's lower ends.

Roughly speaking, the further development consists of configuring the broad sides of the pelt boards in an arched/concave manner in relation to the centre axis of the board, whereby a better counter-hold force is achieved on the areas of the stretched pelt, which experience has shown will give way when use is made of the traditional boards. This configuration of the boards has thus made it possible to fix the pelt in the stretched position on a pelt board during the drying without the use of staples which leave holes in the pelt. These types of boards are sometimes referred to as distension elements and in the description below and in the claims, all references to pelt boards in the context of the present invention are intended to encompass distension elements which are not necessarily boards.

However, this further development of the boards has meant that the known stretching machines, which are intended for use together with the traditional boards described above, which consist of a planar board of pinewood with two opposing broad side surfaces and two narrow side surfaces, are not usable.

Moreover, there has further been a wish to be able to carry out a stretching of the pelts to a degree which is greater than has traditionally been possible, cf. the problems described above.

SUMMARY OF THE INVENTION

The object of the invention is thus to provide a method for non-destructive stretching and fastening of pelts which allows the pelt to be fastened on the board by the use of a holding/fixing bag, which sits tightly around the fur side of the pelt in an area around the lower end, and which also makes it possible to stretch the pelt on the board to a greater degree than that which has hitherto been possible to achieve, without any damage to the pelts in the holding area in the lower end (the tail end) of the pelt.

This object is achieved by a method for the non-destructive stretching and fastening of pelts on a pelt board, for which use is made of a stretching machine of the kind which comprises holding means for engaging the lower end of a respective pelt board, and gripping elements for securing the lower end of a pelt drawn loosely on said pelt board during the stretching of the pelt on the pelt board, where the pelt board is placed in holding means and where the gripping elements comprising inner parts and outer parts are brought into engagement with the pelt by the insertion of the inner parts between the surface of the pelt board and the leather side of the pelt, and where the outer parts outside the inner parts are displaced towards the fur side of the pelt for the fastening of the pelt between the inner parts and the outer parts, where the stretching takes place by effecting a displacement between the gripping elements and the holding means for the lower end of a relevant pelt board, and where an effective fastening of the pelt in the stretched position on the pelt board is established by the drawing of a fixing bag over the outside of the fur side of the pelt, which at least over a part of the pelt's lower end (the tail end) is brought into tight contact with the fur side of the pelt, followed by a releasing of the gripping elements from the pelt and a releasing of the holding means from the pelt board, is characterized in that the gripping elements engage and fasten the pelt substantially along the whole periphery of the pelt.

The very central, new and very important aspect of the method according to the invention is that the lower end (the tail end) of the pelt is engaged by the gripping elements along the whole periphery of the pelt, which results in an even distribution of the holding forces for fastening the pelt's lower end (the tail end), in that the holding forces are distributed over the whole of the periphery of the pelt during the drying process, which is effected by a relative displacement between the pelt board and the gripping elements. Moreover, this also results in the pelt being stretched uniformly over the whole of its periphery, and consequently, it will be possible to effect a stretching of the pelt to a degree which has not hitherto been possible, without damaging the pelt in the area of engaged by the gripping elements, whereas the method hitherto used with pelt boards comprising plate-shaped or beak-shaped gripping elements, respectively, engage locally in the rear part and the leg part over a considerably smaller extent than is the case with the method according to the invention. This means that, with the use of one of the known stretching machines, if attempts are made to stretch the pelt to the extent possible with the method according to the invention, both the belly part as well as the lower end of the back part of the pelt will be damaged or ruined, with the consequent reduction of the price for the relevant pelt which can be obtained by the fur farmer.

Moreover, it is realized that, during the relative displacement between the holding means for the pelt board and the gripping means, it is possible to carry out a further stretching of the pelt by imparting a vibratory movement to the holding means and/or the gripping means which is oriented mainly in the longitudinal direction of the pelt board. In this connection, it is mentioned that the imparting of said vibratory movement is known from International Patent Application Publication WO 02 44428A1 and corresponding U.S. Pat. No. 6,915,669, but the combinations of the method according to the present invention and that known from International Patent Application Publication WO 02 44428 A1 and U.S. Pat. No. 6,915,669 are new, and by being able to achieve a further stretching of the pelts by combining that which is known from International Patent Application Publication WO 02/44428 A1 and U.S. Pat. No. 6,915,669 with the method and the pelt board according to the invention, the increase in the value of the pelts is considerable.

This means that, by the method according to the invention, where the pelt is fastened along the whole periphery at the tail end, and where a greater traction can therefore be exercised in the pelt during the stretching, in combination with the imparting of a vibratory movement, which also affords the possibility for increased stretching of the pelt, and whereby with the imparting of the vibratory movement it is stretched practically speaking over the whole length of the pelt, and not just in the lowermost third part, as is the case with the traditionally known method, hitherto unknown pelt lengths can be achieved without damage to the pelts.

Thus, with the method according to the invention, the possibility is provided of being able to carry out the stretching of pelts from furred animals on pelt boards to an extent which is hitherto unknown which, in many cases, will provide the possibility of being able to stretch the pelts to a whole size category over that which is possible by use of the known method, where counter-holding is established in the pelt's belly part and back part along two relatively narrow areas of engagement on each flat side of the board.

A stretching machine for use in the execution of the method comprises holding means for a pelt board, operable gripping elements for engaging/fastening of the lower end of a pelt drawn loosely on the pelt board, and means for carrying out a relative displacement between the pelt board and the gripping elements, and where the gripping elements comprise at least two inner parts which are inserted in between the surface of the pelt board and the leather side of the pelt from the lower end of the board, and cooperating with the inner parts at least two outer parts with opposing sides which stand in connection with guiding and pressure means for displacement of the outer parts between a closed position where the outer parts are pressed into contact with the fur side of the pelt for fastening of the lower end of the pelt, and an open position where the pelt is free, is characterized in that the sides of the inner parts and the outer parts facing towards the pelt board are configured to match the external shape of the pelt board, so that the gripping elements engage the lower end of the pelt substantially along the whole of the external periphery of the pelt board.

By arranging the gripping elements in such a manner that they can engage and fasten the lower end of the pelt along the whole of its lower periphery, there is thus achieved the possibility of being able to distribute the holding forces during the stretching of the pelt on a pelt board along the whole of said periphery of the pelt board, the result being that, when stretched in the stretching machine, the pelt is stretched uniformly over the whole of its periphery, and the possibility is also provided of being able to exercise a greater traction on the pelt, which provides the possibility of stretching the pelt to a size category which lies above that which is normal. This possibility provides greater earning potential for the fur farmers, who obtain a higher price for pelts delivered to the fur auctions as a result. Moreover, the increased stretching of the pelts will result in lower weight of the pelts which are used for finished fur products, which is preferred by the users of these products.

With the view of further improving the stretching of a pelt placed on a pelt board, on the holding means and/or gripping means of the stretching machine, there can be mounted an operable vibrator unit with a vibration amplitude oriented substantially in the longitudinal direction of the pelt board. There is hereby carried out a stretching of practically the whole of the pelt, unlike with the traditional method where approx. between one-third and a half of the lower end of the pelt is stretched. Combined with the increased traction which is now possible with the machine according to the invention, where the special construction of the gripping elements makes it possible to distribute the tractive forces along the whole periphery of the pelt, there will thus be the possibility of achieving a considerable increase in the value of the pelts which are stretched and fastened in the stretched position by the method and the machine according to the invention.

With the view of achieving an improved holding force between the inner parts and the outer parts, the inner parts can comprise an upper counter-hold flange, the edge of which facing away from the pelt board comprises a track, and the sides of the outer parts facing towards the upper edge comprising a pressure flange cooperating with the track and having an edge with a shape which corresponds to the shape of the track. By the clamping of the lower peripheral edge of the pelt between the counter-hold flange and the edge of the pressure flange, there will hereby be established a peripheral and, in relation to the direction of the relative displacement between the holding means for the pelt board and the gripping means, a transversely-directed counter-hold edge, which provides the possibility of reducing the pressure between the pressure flange and the counter-hold flange, and the size of the pressure means which exercise this pressure can herewith be reduced, and herewith also the energy which is used to establish this pressure.

A preferred embodiment of the stretching machine is further characterised in that the inner parts of the gripping elements are comprised of two similarly-shaped, open but laterally reversed half parts which are displaceable towards each other, and which are mounted on respective brackets which, by a pivot connection, are disposed opposite each other, the brackets being displaceable via actuators towards each other and away from each other, between a closed position where the subtending end parts of the inner parts are more or less in contact with each other, and an open position where the inner parts are lying at a distance from each other, and where the outer parts are placed on pivotal arms for the respective brackets, said arms being displaceable with actuators between a position where the flange edges are pressed against the tracks in the upper edge of the inner parts, and a position where said flange edges are lying at a distance from said tracks.

With the disclosed construction of the gripping elements, good possibilities are thus achieved for the placing of a pelt board between the inner parts since, at the same time as these parts are displaced to the open position, there occurs a corresponding displacement of the outer parts, which are disposed pair-wise on the same brackets as the inner parts.

Without renouncing other embodiments, is noted that, in a specially preferred embodiment of the inner parts of the gripping elements, which are intended for the fastening of pelts on pelt boards having broad sides which are arched/concave in relation to the center axis of the board, the subtending sides of the inner parts can extend in a concave manner.

It is hereby achieved that the pelt is gripped substantially along the whole periphery of the pelt along the sides of the distension element.

With a view to ensuring good possibilities for the placing of the fixing bag which is drawn over the fur side of the pelt for fastening of the pelt in the stretched position, the counter-hold flanges can stand upright from a plane part which is oriented in a substantially transverse manner in relation to the extent of the counter-hold flanges.

With the method and the apparatus for the execution of the method, there is thus provided the possibility of carrying out the stretching and fastening of a pelt by use of newly-developed pelt boards in a staple-free manner which, at the same time, opens possibilities for the stretching of the pelt to a hitherto unknown degree, without the pelt being damaged in the areas of engagement for the gripping elements.

In the following, the invention is explained in more detail with reference to the accompanying drawings.

DETAILED DESCRIPTION OF THE INVENTION

Figure 1:
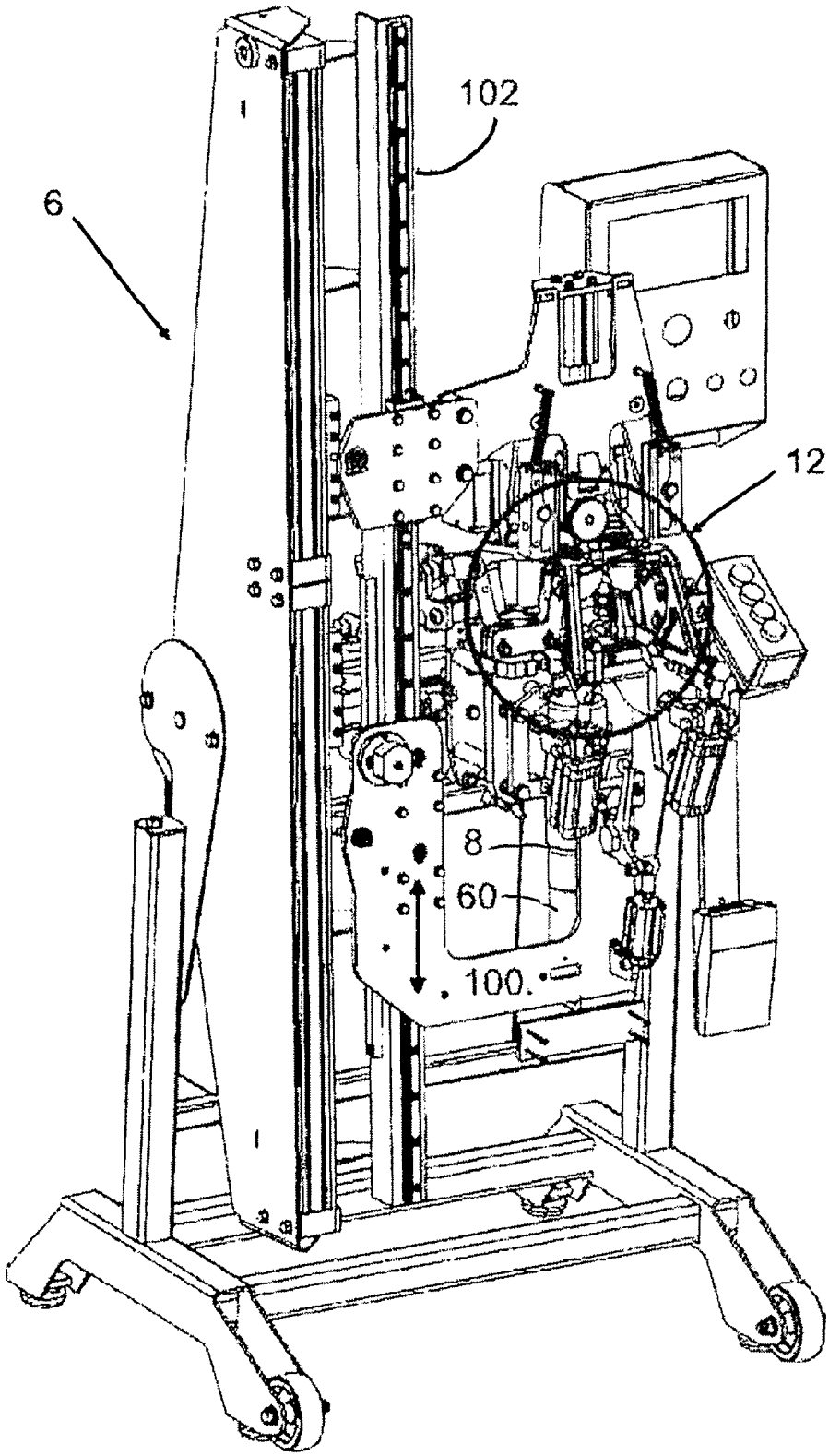
FIG. 1 is a perspective view of a stretching machine for the execution of the method according to the invention.

FIG. 1 shows a stretching machine 6 for the execution of the method according to the invention which comprises a holding means 8 for engaging/fastening of the lower end 24 of a pelt board 4 (not shown in this figure), the holding means in this embodiment of the machine 6 being placed on a U-shaped bracket plate 100 which is housed in a displaceable manner in a guide rail 102. The displacement of the bracket plate 100 and with it the holding means 8 in the direction of the guide rail takes place via an actuator (not shown), which typically comprises a pneumatic plunger (not shown). The machine 6 further comprises gripping elements 12 disposed at a level above the holding means 8, and whose positioning is enclosed within circle 12, and which are shown in greater detail in FIG. 2.

Figure 2:
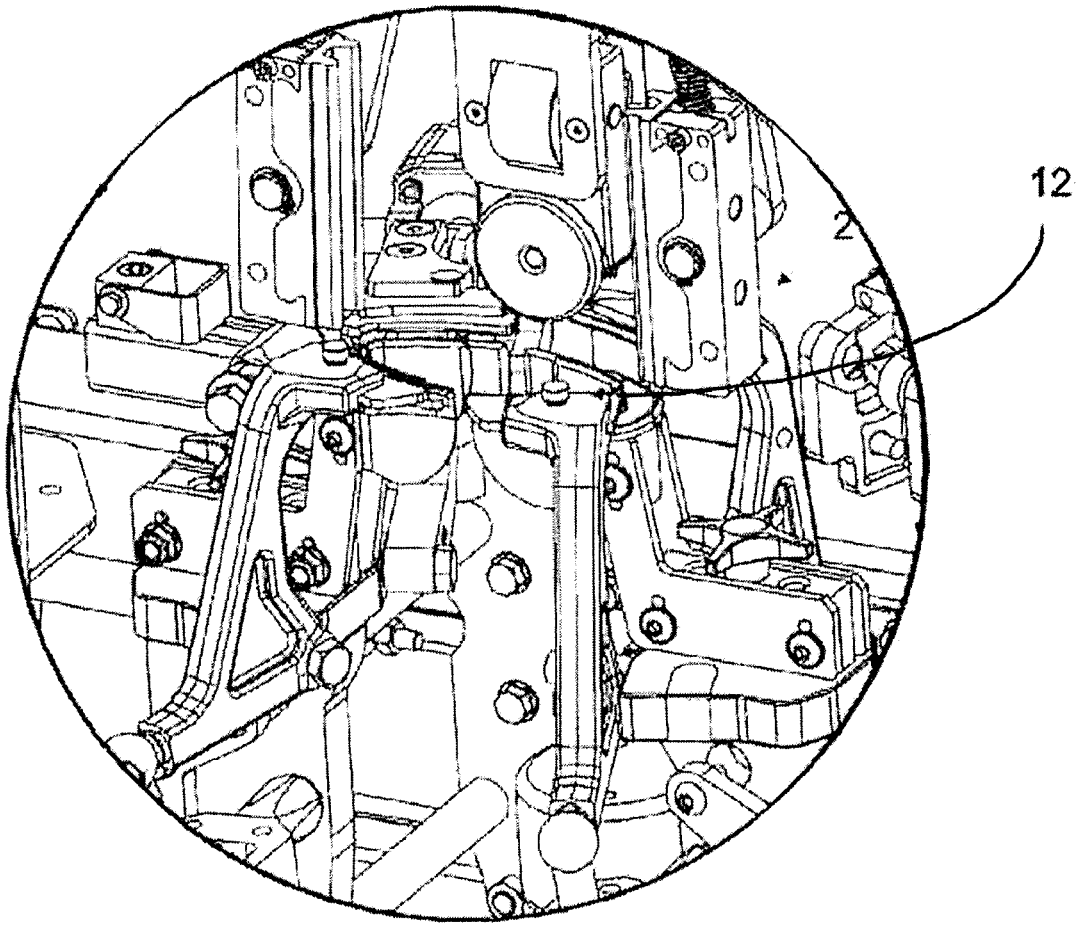
FIG. 2 is a perspective view of the encircled section around the machine's gripping elements of the machine shown in FIG. 1, according to the invention.
Figure 3:
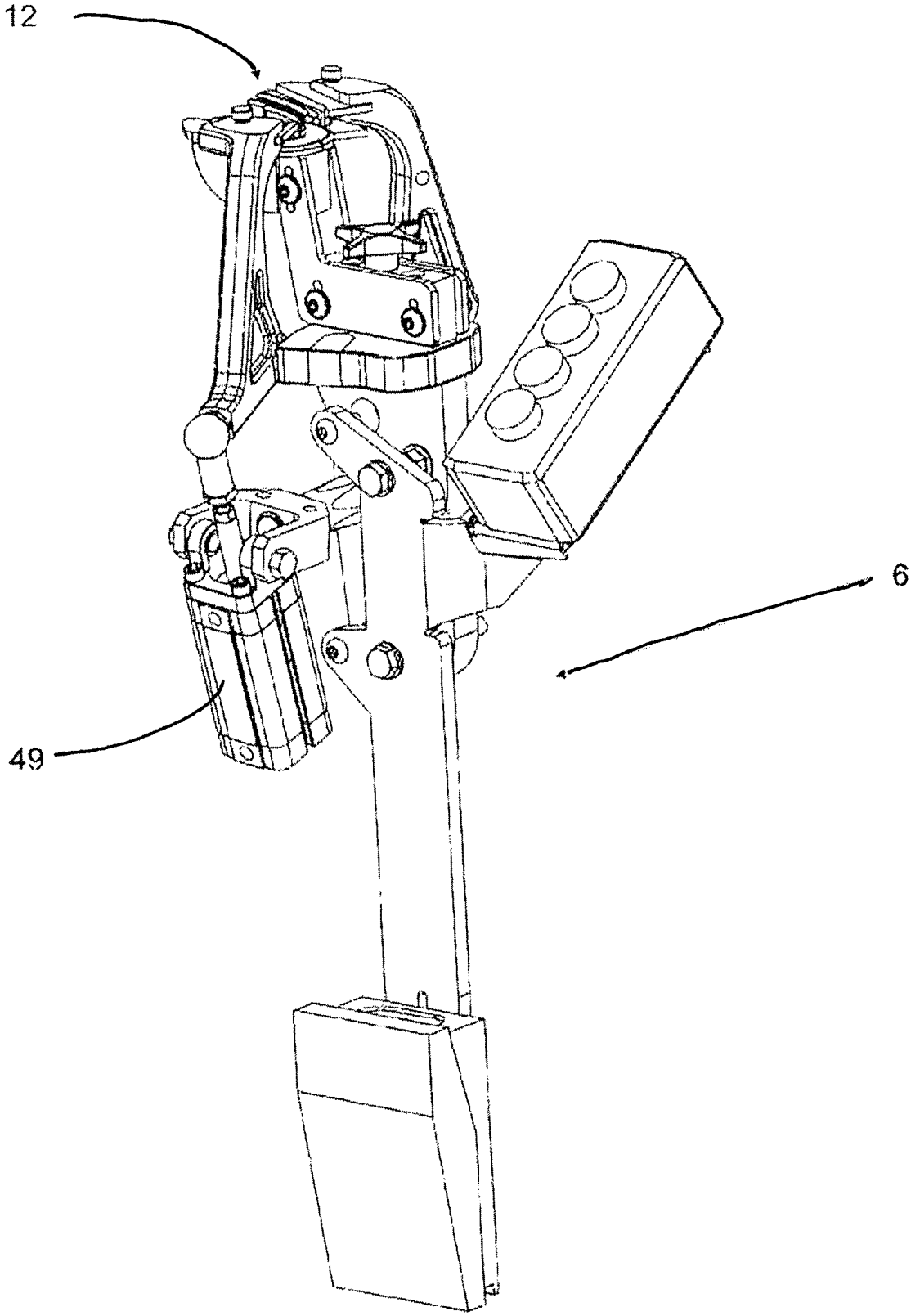
FIG. 3 is a perspective view of a half part of the gripping elements shown in FIG. 2.

FIG. 3 is a perspective view of one half part of the gripping elements 12 shown in FIG. 2.

Figure 4:
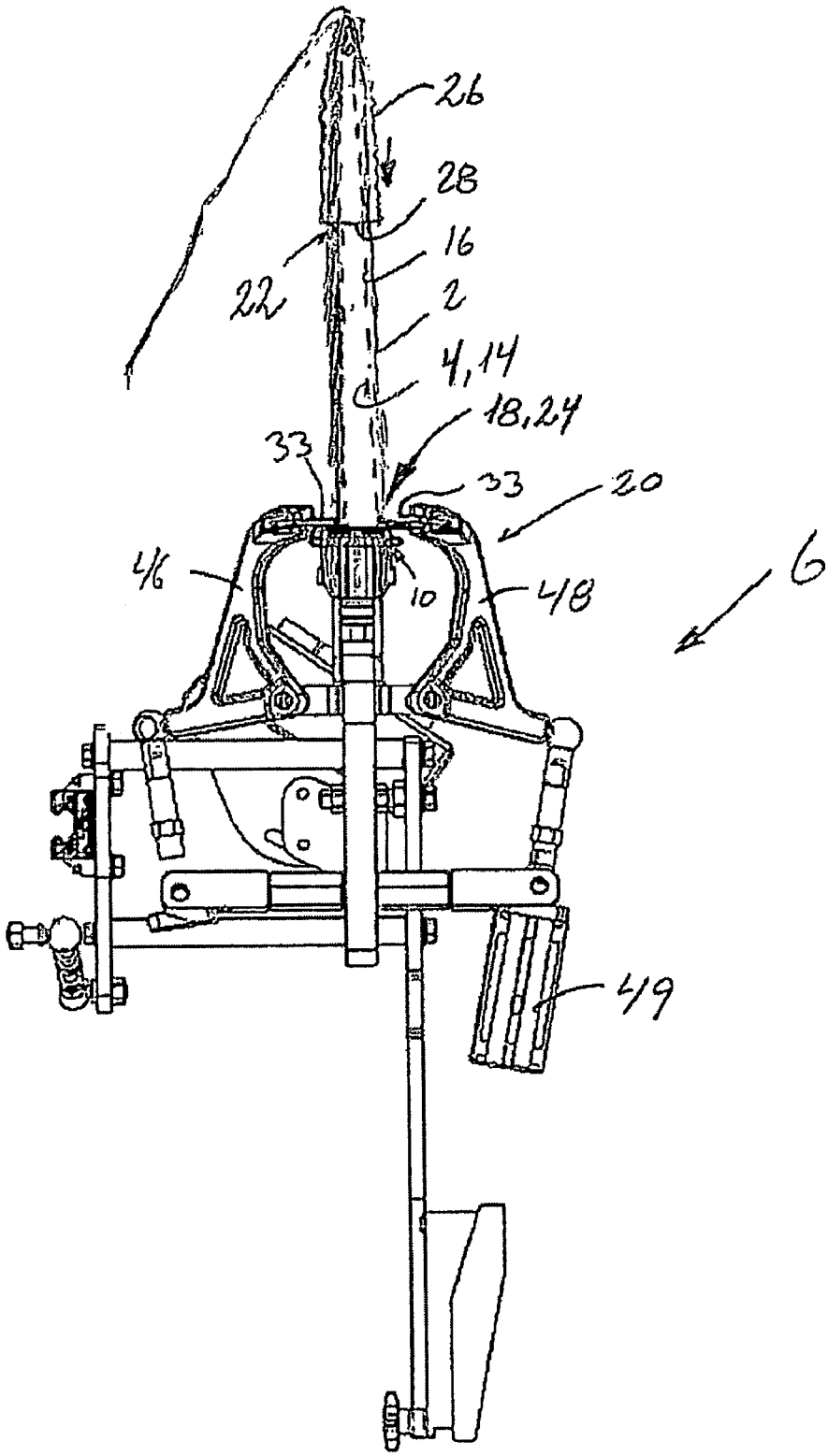
FIG. 4 is a side view of the gripping elements shown in FIG. 3.

FIG. 4 is side view of the gripping elements 12 of FIG. 2 in the machine 6 of FIG. 1, and indicates how a pelt board 4, onto which a pelt 2 has been drawn, is disposed between the gripping elements 12. FIG. 4 also indicates the surface 14 of the pelt board 4, the fur side 22 of the pelt, a fixing bag 26 for the fixing of the pelt 2 in the stretched position on the board 4. The lower ends 28 of the bag which, after the pelt has been stretched on the pelt board 4 by means of the machine 6 and fastened in this position, is intended for a further drawing-on so that the bag's lower end is placed in the area at the tail end 18 of the pelt, in an area around the pelt's tail end, where it will sit tightly around the fur side 22 of the pelt, and thereby press the leather side 16 of the pelt against the surface 14 of the pelt board, whereby sufficient friction is created to fasten the pelt in its stretched position during the consequent drying of the leather side 16 of the pelt. FIG. 4 also indicates where the lower end 24 of the pelt board is placed and the lower end (the tail end) 18 of the pelt. FIG. 4 also shows actuators 49 with pivotally mounted arms 46, 48 on which outer parts 20 of the gripping elements 12 are placed.

Figure 5:
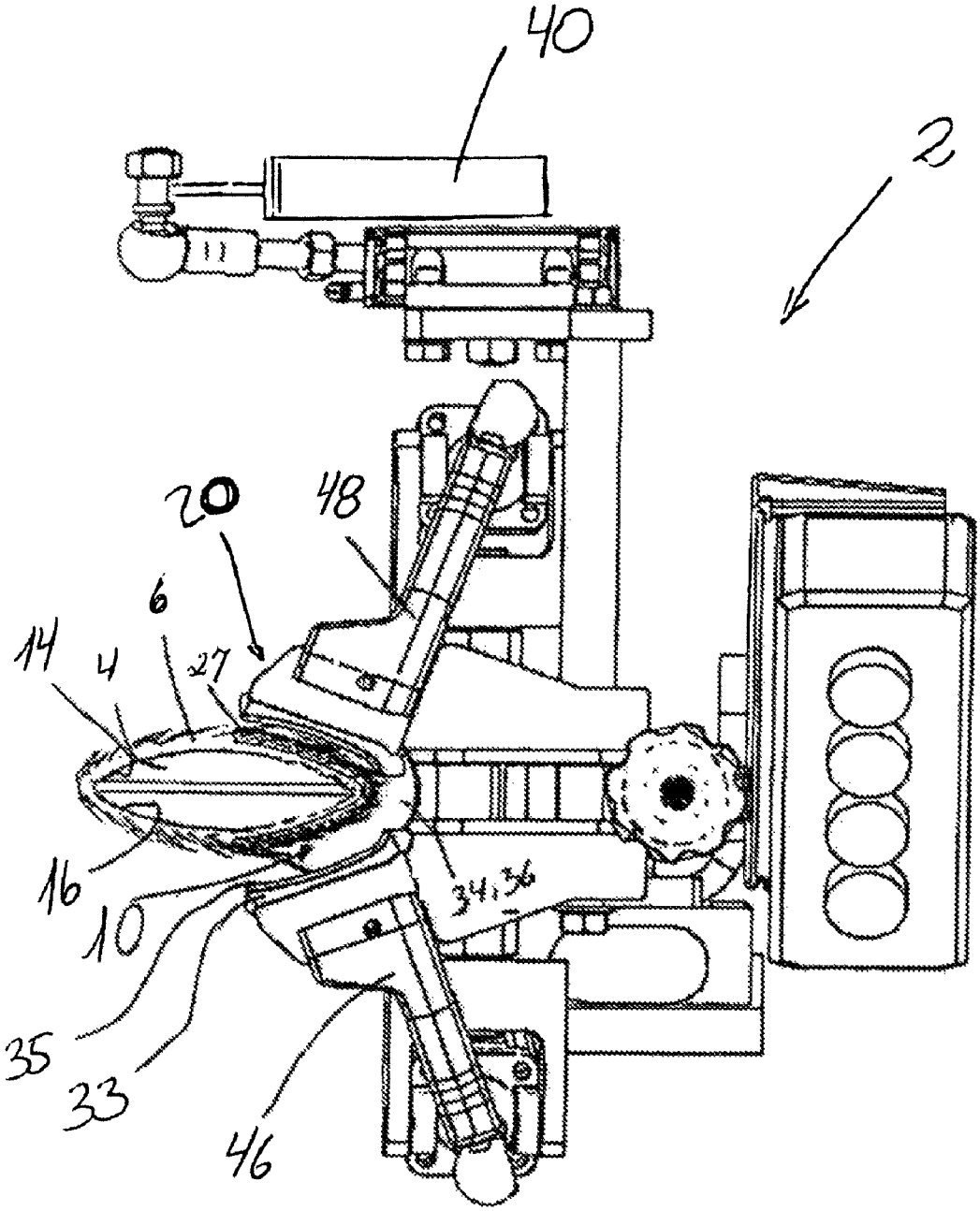
FIG. 5 is a plan view of the gripping elements shown in FIG. 2.

In FIG. 5, which is a plan view of the gripping elements 12 shown in FIG. 4, it is seen how the pelt board 4 with the pelt 2 is placed in relation to the inner parts 10 and outer parts 20 of the gripping elements 12, again showing the pelt board 4, and how the leather side 16 of the pelt is in contact with the surface 14 of the pelt board 4.

Figure 6:
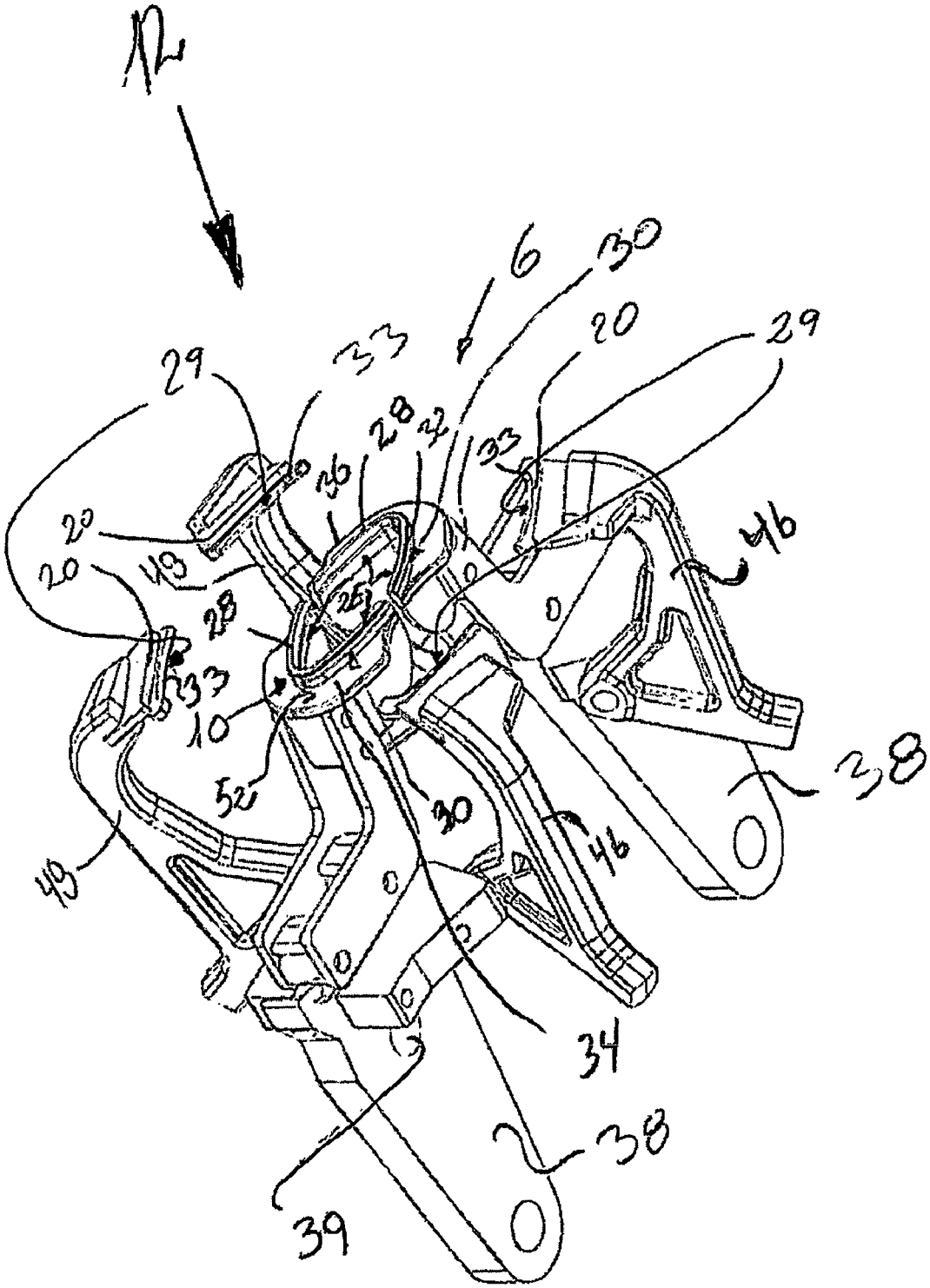
FIG. 6 is a perspective view of the gripping elements shown in FIG. 2, seen in the open position.
Figure 7:
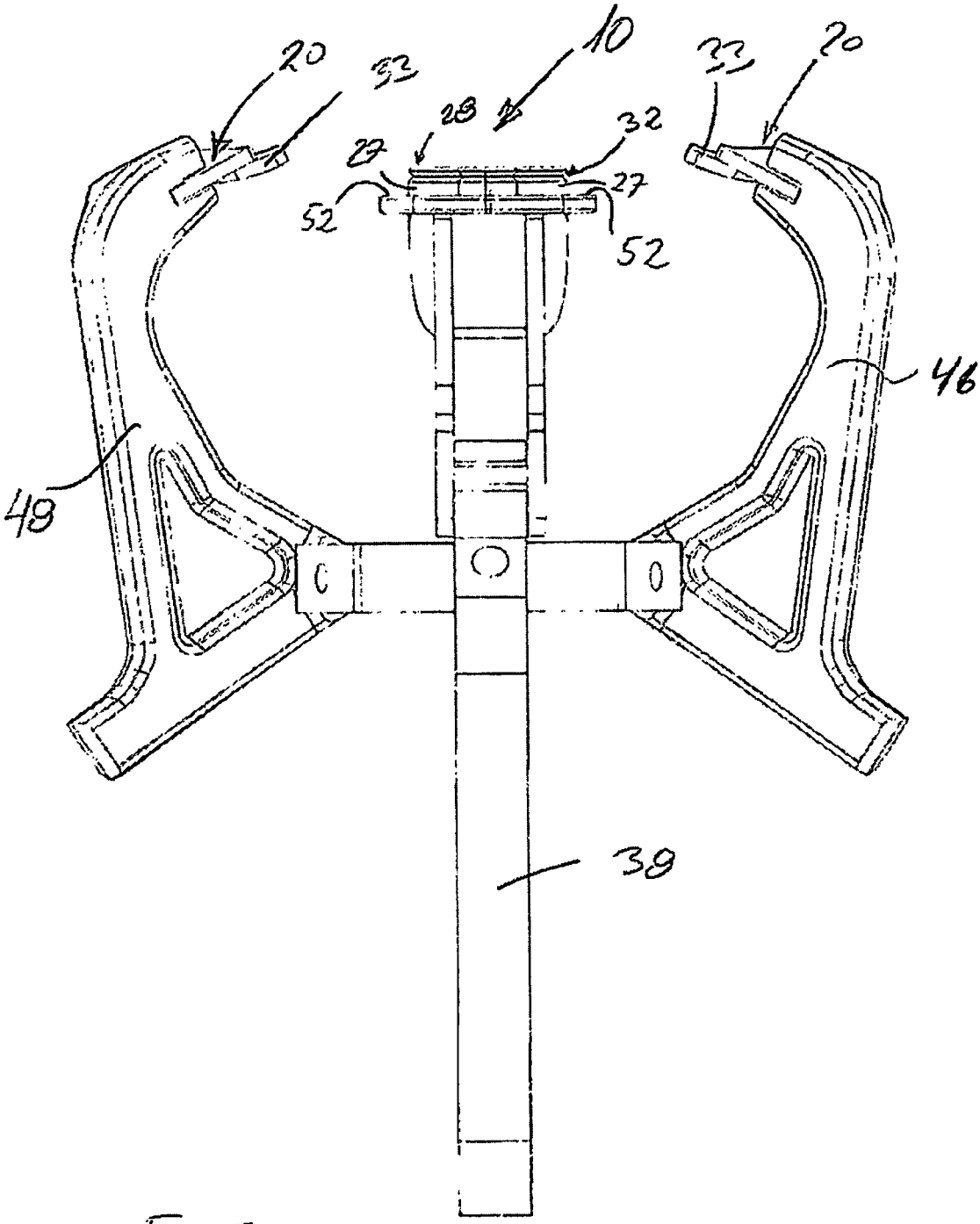
FIG. 7 is a side view of the gripping elements shown in FIG. 6.
Figure 8:
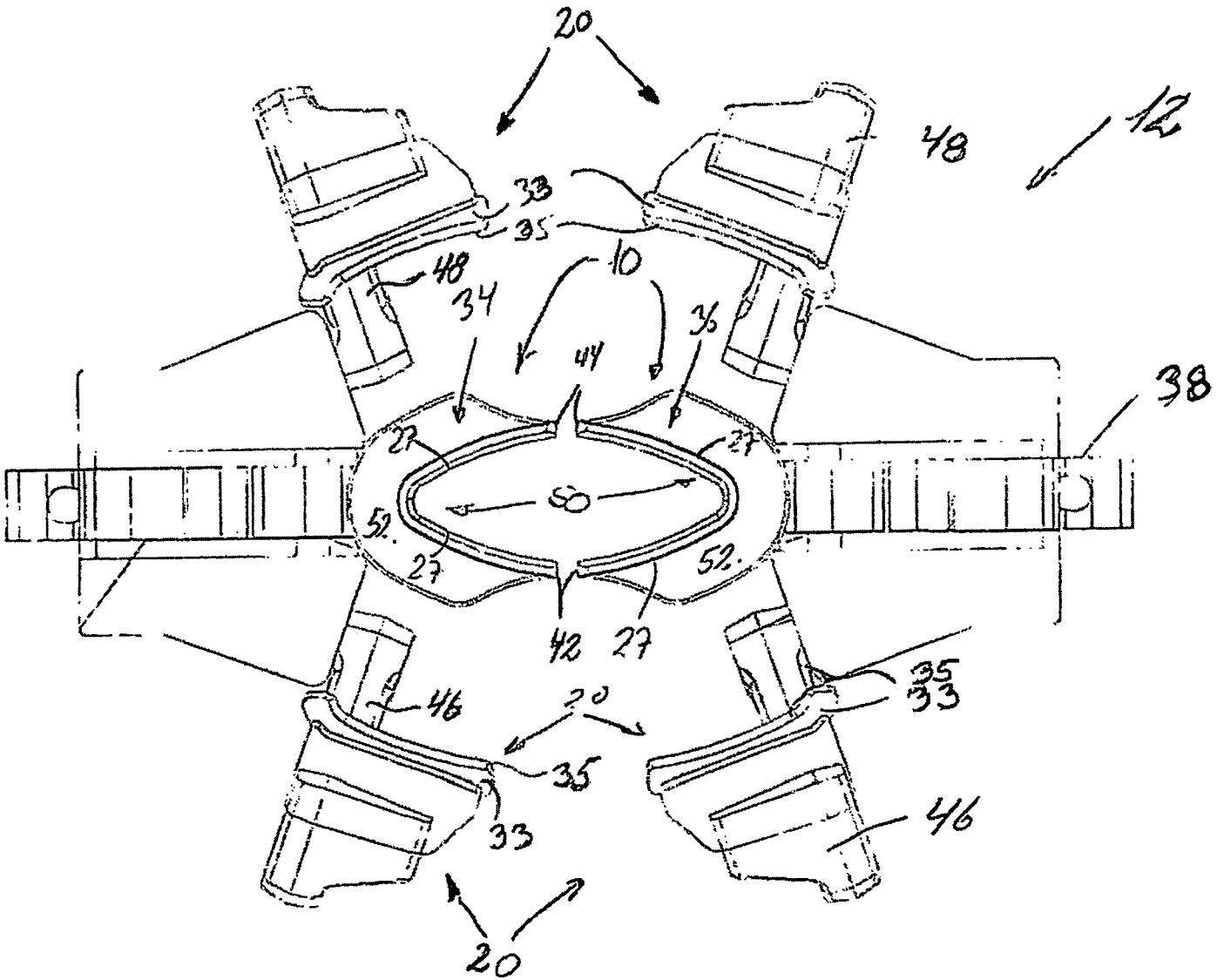
FIG. 8 is a top plan view of the gripping elements shown in FIGS. 6 & 7.

As will appear from FIGS. 6-8 and elsewhere, the gripping elements 12 comprise inner parts 10 and outer parts 20. The inner parts 10 of the gripping elements 12 comprise open, but laterally reversed, half parts 34, 36 which are displaceable towards each other, and which extend in an arched manner. The half parts 34, 36 are mounted on respective brackets 38 which, by a pivot connection 39, are disposed opposite each other, and via actuators 40 (shown in FIG. 5), the brackets 38 are displaceable towards and away from each other between a closed position, where the subtending end parts 42, 44 of the inner parts 10 are more or less in contact with each other and with the surface 14 of the pelt board 4, and an open position where the inner parts 10 are lying at a distance from each other.

Figure 10:
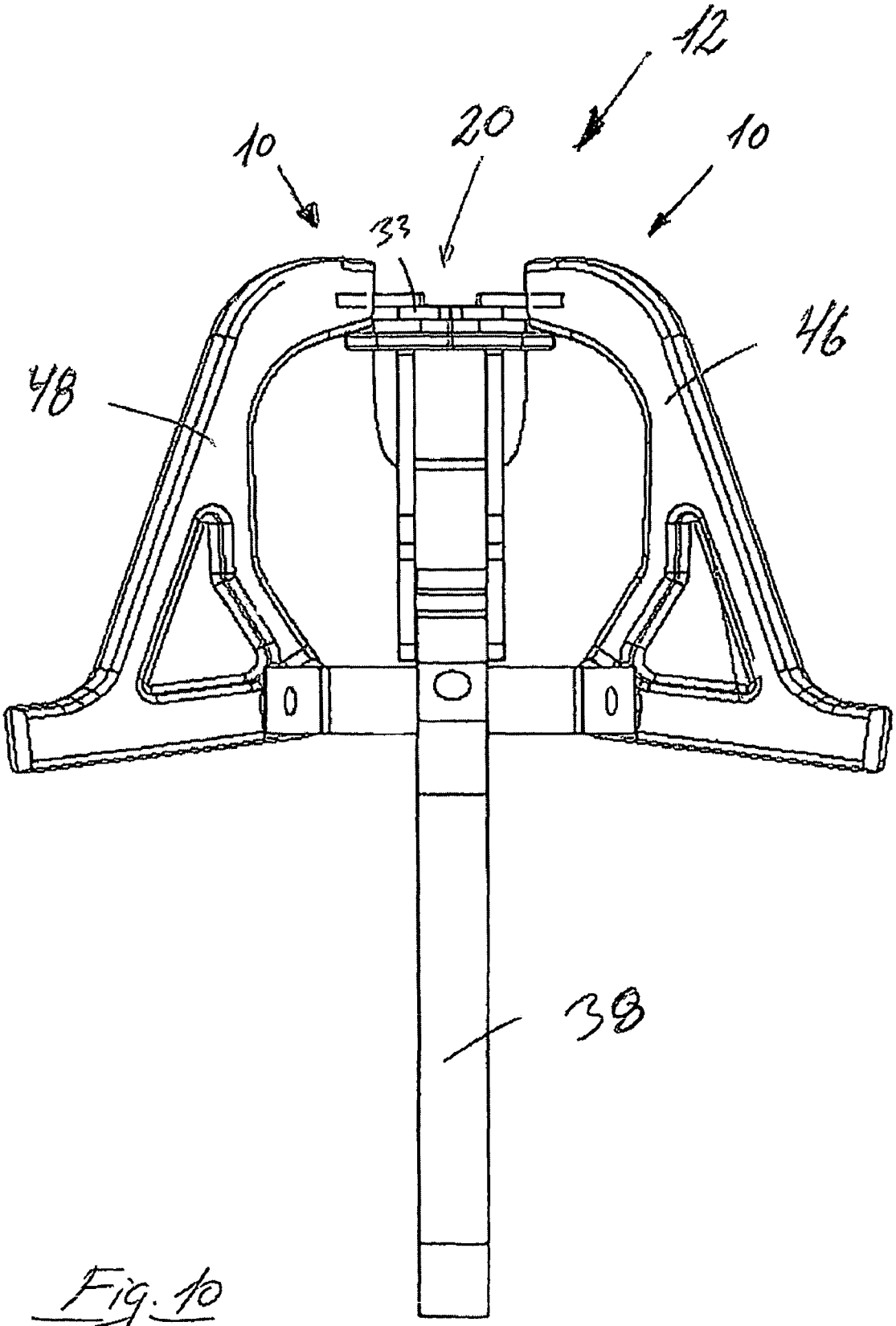
FIG. 10 is a side view of the gripping elements shown in FIG. 9.
Figure 12:
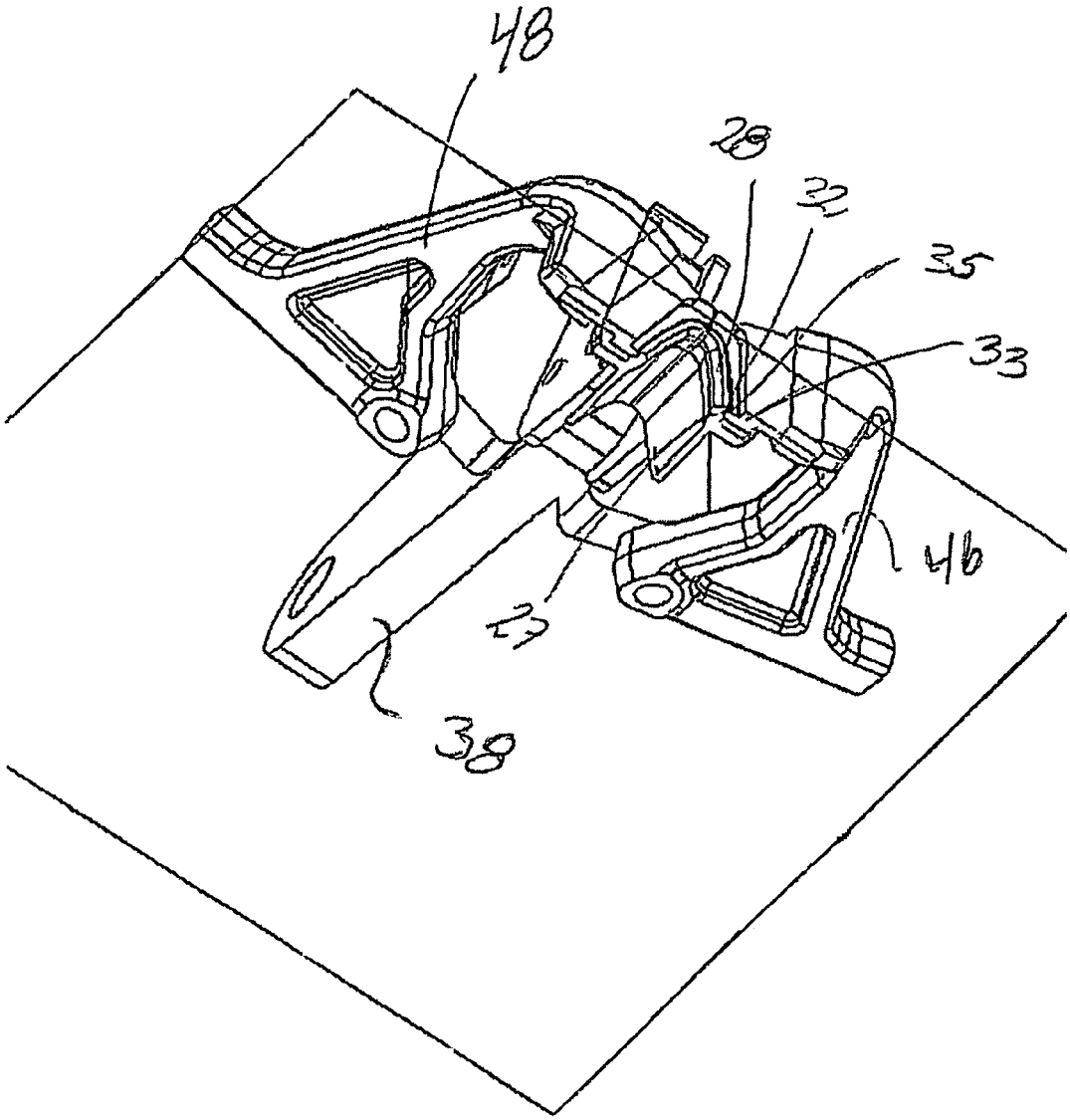
FIG. 12 is a perspective view of a section of the gripping elements shown in FIG. 9.

The outer parts 20 are placed on the respective brackets 38 by pivotally mounted arms 46, 48, these arms 46, 48 being displaceable via actuators 49 (FIGS. 3-5) between a position in which the flange edges 33 are pressed against track 32 in the upper edge 28 of the inner parts 10, cf. FIGS. 10 & 12, and a position in which the flange edges 33 lie at a distance from track 32.

Figure 11:
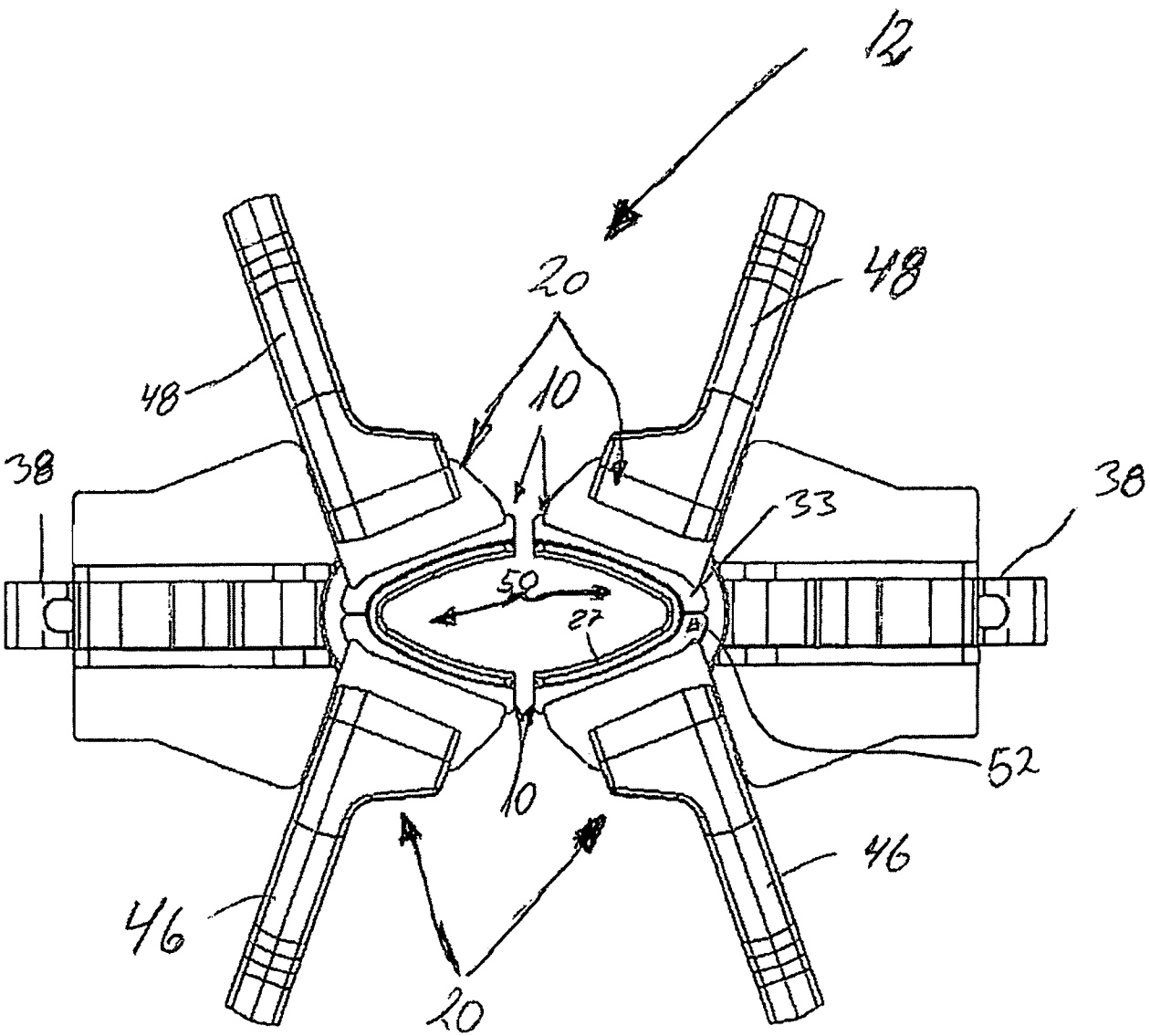
FIG. 11 is a top plan view of the gripping elements shown in FIG. 10.

As further appears from FIG. 11, in the illustrated embodiment, the subtending sides 50 of the inner parts 10 extend in a concave manner, which is suitable for a pelt board 4 with broad sides which are arched/concave in relation to the center axis of the board in at least two directions. It is noted that the inner parts 10 and the outer parts 20 can be of other configurations, corresponding with pelt boards with cross-sectional shapes other than that shown here. For example, the subtending sides can be configured to accommodate boards with a rectangular cross-section.

As further appears from FIG. 11, but more clearly in FIG. 7, the counter-hold flanges 27 stand upright from a planar part 52 which is oriented in a substantially transverse manner in relation to the extent of the counter-hold flanges. This offers the advantage that the lower end 24 of the pelt will be retained on the plane part 52 during the introduction of the counter-hold flanges 27 between the surface/outer side 14 of the pelt board and the leather side 16 of the pelt.

Figure 9:
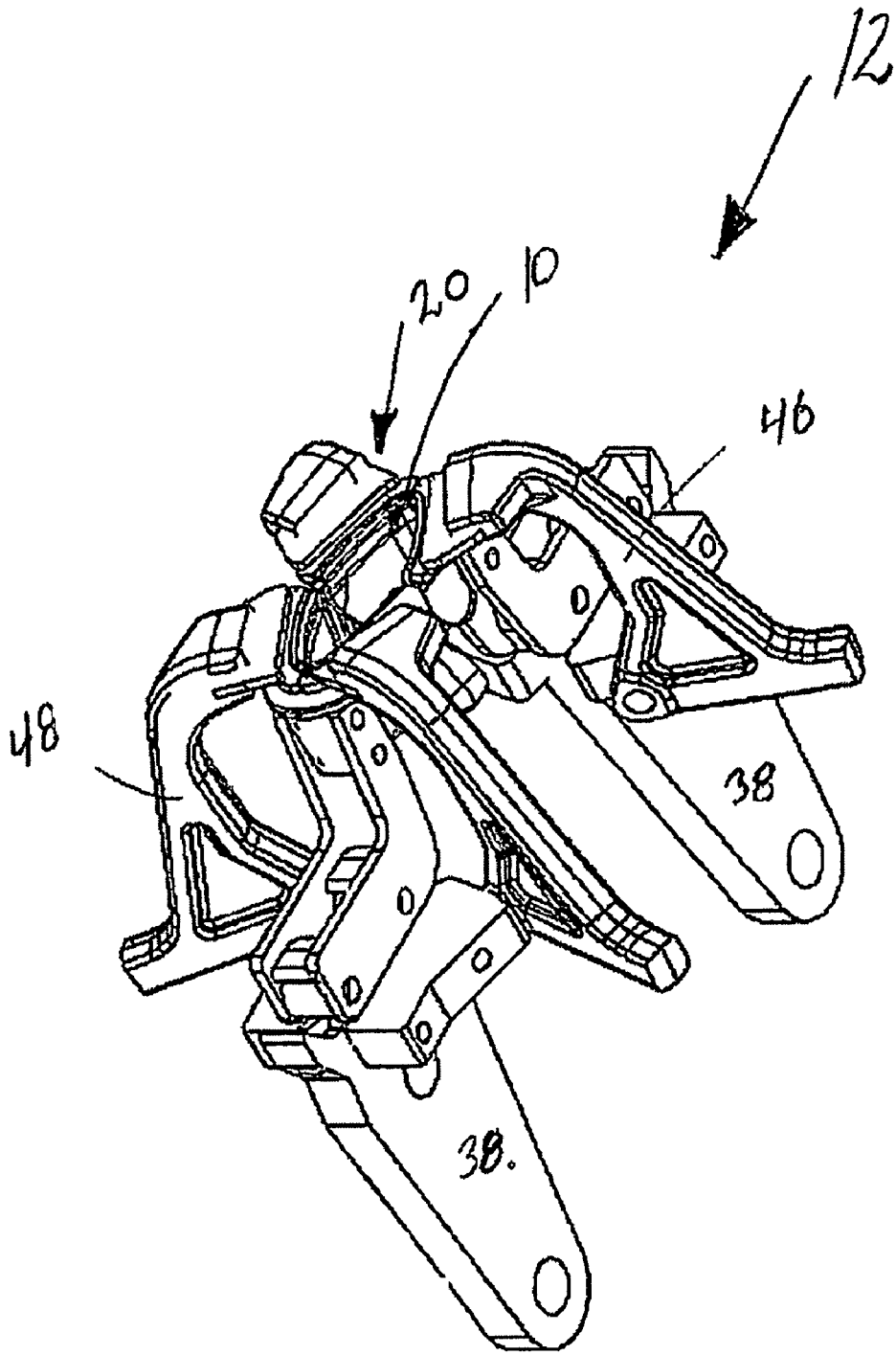
FIG. 9 is a perspective view of the gripping elements shown in FIG. 2, seen in the closed position.

In FIGS. 9-11, the gripping elements 12 are shown in the closed position, so that that the edges 35 are lying in the tracks 32 in the counter-hold flange 27. Namely in FIG. 12, which is a sectional view of the gripping elements 12, it is seen how the shape of the tracks 32 in the counter-hold flange 27 and the edges 35 of the pressure flanges 33 on the outer parts 20 match one another, i.e., with the gripping elements in the closed position, where the lower end 24 of a pelt is clamped between the track 32 and the edge 35 of the pressure flange, there is formed a transversely-directed edge over which the pelt is fastened by the gripping elements, which results in a very effective fastening during the stretching of the pelt on the pelt board 4.

Moreover, the inner parts 10 and the outer parts 20 are configured in such a manner that, in the closed position of the gripping elements, they allow a fixing bag to be led down over a pelt stretched on the pelt board, which is achieved by the combination of the pressure flanges 33 and the tracks 32 in the upper edge of the counter-hold flange 27 of the inner parts.

Thus, with the invention, there is provided a method and a machine for the mechanical, non-destructive stretching and fastening of pelts, by the drawing-on of a fixing bag to a level lying below the lower edge of the pelt in the stretched condition, the result being that there is no need for a further fastening of the pelt on the pelt board, whereby the use of staples which penetrate the pelt and the pelt board is rendered superfluous. Moreover, with the configuration of the machine 6, and namely its gripping elements 12, the shape of which corresponds to the geometry of the distension element, including that the gripping elements 12 engage the lower end 24 of the pelt along practically the whole of its periphery, the possibility is achieved of being able to stretch the pelts to a hitherto unknown extent, without the pelt being damaged in the area of engagement of the gripping elements, the reason being that the tractive forces in the holding/engagement area for the gripping elements 12 are distributed along the whole periphery of the pelt during the stretching of the pelt 2, which is effected by a relative displacement of the pelt board 4 and the gripping elements 12, typically by effecting a displacement of the holding means 8 for the foot 24 of the pelt board placed on U-shaped bracket plate 100 in the direction of the guide rail 102.

As already mentioned, the stretching of the pelt can be further increased by activating a vibrator unit 60 during the above-described stretching of the pelt, which naturally places further demands regarding the distribution of the tractive forces in the area where the gripping elements 12 engage the lower end 18 (the tail end) of the pelt which, with the gripping elements 12 according to the invention, these demands are fulfilled.

Therefore, with the invention, there is achieved an almost revolutionary development of the stretching and fastening procedure, which is expected to be introduced as standard within the production of pelts, and which will change the competitive conditions on the market to a considerable degree.

As already mentioned, the inventor has recognized that the gripping elements for the stretching machine for the execution of the method according to the invention can be of configurations other than that disclosed in the present description, but this does not change the inventive aspect, which comprises providing a method where a pelt, during the stretching procedure, is engaged by gripping elements, practically speaking, along the whole of the lower edge of the pelt, by configuring the gripping elements with a cross-section which is corresponds to that of a then-current pelt board.

What is claimed is:

1. Method for non-destructive stretching and fastening of a pelt (2) on a pelt board (4), for which use is made of a stretching machine (6) of the kind comprising holding means (8) for engaging the lower end (24) of a relevant pelt board (4), and gripping elements (12) for fastening of the lower end (24) of a pelt (2) drawn loosely over said pelt board during the stretching of said pelt (2) on the pelt board (4), where the pelt board (4) is placed in holding means (8) and where the gripping elements (12) comprising inner parts (10) and outer parts (20) are brought into engagement with the pelt (2) by the introduction of the inner parts (10) between the surface (14) of the pelt board and the leather side (16) of the pelt, and the outer parts (20) opposite the inner parts (10) are displaced towards the fur side (22) of the pelt for the fastening of the pelt (2) between the inner parts (10) and the outer parts (20), where the stretching takes place by effecting a displacement between the gripping elements (12) and the holding means (8) for the lower end of a relevant pelt board (4), and where an effective fastening of the pelt (2) in the stretched position on the pelt board is established by the drawing of a fixing bag (26) over the outside of the fur side (22) of the pelt, which at least over a part of the lower end (18) (the tail end) of the pelt is brought into tight contact with the fur side (22) of the pelt, followed by a releasing of the gripping elements (12) from the pelt (2) and a releasing of the holding means (8) for the pelt board (4), characterised in that the gripping elements (12) engage with and fasten the pelt (2) substantially along the whole periphery of the pelt.

2. Method according to claim 1, characterised in that during the relative displacement between the holding means (8)

for the pelt board (4) and the gripping elements (12), a vibratory movement is imparted to said holding means (8) and/or the gripping elements (12), said movement oriented substantially in the longitudinal direction of the pelt board.

3. Stretching machine for use in the execution of the method disclosed in claim 1, and comprising holding means (8) for a pelt board (4), gripping elements (12) which can be activated forengagement/fastening of the lower end (24) of a pelt (2) drawn loosely over pelt board (4), and means for effecting a relative displacement between the pelt board (4) and the gripping elements (12), and where the gripping elements (12) comprise at least two inner parts (10) which are led between the surface (14) of the pelt board (4) and the leather side (16) of the pelt from the lower end (24) of the board, and cooperating with the inner parts (10) at least two outer parts (20) with subtending sides which stand in connection with guiding and pressure means for displacement of the outer parts (2) between a closed position, where the outer parts are pressed into contact with the fur side (22) of the pelt for the fastening of the lower end of the pelt (2), and an open position where the pelt (2) is free, characterised in that the sides (25,29) of the inner parts (10) and the outer parts (20) respectively, said sides (25,29) facing towards the pelt board (4), are configured to match the shape of the pelt board (4), so that the gripping elements (12) engage with the lower end (18) of the pelt substantially along the whole of the outside periphery (14) of the pelt board (4).

4. Stretching machine (6) for execution of the method according to claim 2, characterised in that on the holding means (8) and/or the gripping elements (12) there is a vibrator unit (60) (which can be activated), the vibration amplitude of which is oriented substantially in the longitudinal direction of the pelt board.

5. Stretching machine according to claim 3 or 4, characterised in that the inner parts (10) comprise an upper counter-hold flange (27), the edge (28) of which on the side (30) facing away from the pelt board (4) comprises a track (32), and that the sides of the outer parts (20) facing towards the upper edge (28) comprise a pressure flange (33) which cooperates with the track (32) and has an edge (35) with a shape which corresponds to the shape of the track (32).

6. Stretching machine according to any of the claims 3-5, characterised in that the inner parts (10) of the gripping elements (12) consist of two open, similarly-shaped but laterally reversed half parts (34,36) which are displaceable towards each other, and which are housed on the respective brackets (38) which are disposed opposite each other via a pivot connection, where by actuators (40) said brackets (38) are displaceable towards and away from each other between a closed position where the subtending sides (42,44) of the inner parts (10) are more less in contact with each other, and an open position where the inner parts (10) are lying at a distance from each other, and where the outer parts (20) are placed on pivotally mounted arms (46,48) for the respective brackets (38), said arms (46,48) being displaceable by actuators between a position where the flange edges (33) are pressed in against the tracks (32) in the upper edge (28) of the inner parts (10), and a position where said flange edges are lying at a distance from said tracks (32).

7. Stretching machine according to any of the claims 3-6, characterised in that the subtending sides (50) of the inner parts (10) extend in a concave manner.

8. Stretching machine according to any of the claims 3-7, characterised in that the counter-hold flanges (27) stand up from a plane part (52) which is oriented in a substantially transverse manner in relation to the extent of the counter-hold flanges.

* * * * *